US009541039B2

(12) United States Patent
Kolhouse et al.

(10) Patent No.: US 9,541,039 B2
(45) Date of Patent: Jan. 10, 2017

(54) APPARATUS, SYSTEM, AND METHOD FOR REDUCING EMISSION OF NITROGEN OXIDES

(71) Applicant: Cummins IP, Inc., Columbus, IN (US)

(72) Inventors: J. Steven Kolhouse, Columbus, IN (US); Vivek A. Sujan, Columbus, IN (US); Thomas M. Yonushonis, Columbus, IN (US)

(73) Assignee: CUMMINS IP, INC., Columbus, IN (US)

( * ) Notice: Subject to any disclaimer, the term of this patent is extended or adjusted under 35 U.S.C. 154(b) by 275 days.

(21) Appl. No.: 14/175,253

(22) Filed: Feb. 7, 2014

(65) Prior Publication Data

US 2014/0261342 A1 Sep. 18, 2014

Related U.S. Application Data

(60) Provisional application No. 61/784,685, filed on Mar. 14, 2013.

(51) Int. Cl.
*F02M 25/07* (2006.01)

(52) U.S. Cl.
CPC ..... *F02M 26/37* (2016.02); *F02M 26/05* (2016.02)

(58) Field of Classification Search
CPC ..... F02B 21/00; F02B 37/00; F02B 37/164; F02B 33/44; F02D 21/08; F02D 9/04; F02D 41/00; F02D 41/0007; F02M 23/06; F02M 25/07; F02M 25/0743; F02M 25/0713; Y02T 10/144; Y02T 10/47; Y02T 10/6208
USPC ..... 123/568.11, 568.13, 568.2, 568.21; 701/103, 108, 109; 60/281, 605.1, 605.2, 60/611
See application file for complete search history.

(56) References Cited

U.S. PATENT DOCUMENTS

| | | | | |
|---|---|---|---|---|
| 6,164,063 | A * | 12/2000 | Mendler | F01N 3/2882 60/274 |
| 6,250,073 | B1 * | 6/2001 | Zimmer | F01N 3/18 180/165 |
| 6,901,743 | B2 * | 6/2005 | Asanuma | F01N 3/20 60/274 |
| 7,367,327 | B2 * | 5/2008 | Piriou | F02D 41/0007 123/323 |
| 8,528,332 | B2 | 9/2013 | Pursifull et al. | |
| 8,955,499 | B2 * | 2/2015 | Takamiya | F02M 25/0726 123/568.12 |
| 2003/0127077 | A1 * | 7/2003 | Sisken | F02D 21/08 123/568.11 |
| 2007/0089715 | A1 * | 4/2007 | Kolavennu | F02B 37/02 123/568.11 |

(Continued)

*Primary Examiner* — John Kwon
*Assistant Examiner* — Johnny H Hoang
(74) *Attorney, Agent, or Firm* — Foley & Lardner LLP

(57) ABSTRACT

An apparatus, system and method for reducing the emission of nitrogen oxides in an internal combustion engine system. Exhaust gas directly or indirectly downstream of the internal combustion engine is at least selectively stored in an exhaust gas storage region. Upon the occurrence of at least one enablement condition, indicative of a potential period where the emission of nitrogen oxides (NOx) will increase, the stored exhaust gas is inserted into the internal combustion engine to assist in reducing the emission of the nitrogen oxides. The exhaust gas storage volume regularly, or the exhaust gas storage volume may be filled during strategic periods when the emissions of nitrogen oxides are low and/or there is a low need for the recirculation of exhaust gas.

36 Claims, 4 Drawing Sheets

(56) References Cited

U.S. PATENT DOCUMENTS

| | | | | |
|---|---|---|---|---|
| 2009/0032000 | A1* | 2/2009 | Rim | F01N 5/02 123/568.12 |
| 2010/0257845 | A1* | 10/2010 | Iwamoto | B01D 53/9495 60/278 |
| 2011/0054762 | A1* | 3/2011 | Nakayama | F02D 41/0072 701/108 |
| 2011/0094482 | A1* | 4/2011 | Weber | F02M 25/071 123/568.12 |
| 2011/0132335 | A1* | 6/2011 | Pursifull | F02B 21/00 123/564 |
| 2011/0203260 | A1* | 8/2011 | Umemoto | F01N 3/0842 60/278 |
| 2013/0305714 | A1 | 11/2013 | Rollinger et al. | |
| 2013/0305715 | A1 | 11/2013 | Rollinger et al. | |
| 2013/0305716 | A1 | 11/2013 | Rollinger et al. | |
| 2013/0305718 | A1 | 11/2013 | Rollinger et al. | |

* cited by examiner

APPARATUS, SYSTEM, AND METHOD FOR REDUCING EMISSION OF NITROGEN OXIDES

CROSS-REFERENCE TO RELATED APPLICATIONS

The present application claims priority to U.S. Provisional Patent Application No. 61/784,685, filed Mar. 14, 2013 and the contents of which are hereby incorporated by reference in their entirety.

BACKGROUND

Emissions regulations for internal combustion engines have become more stringent over recent years. Environmental concerns have motivated the implementation of stricter emission requirements for internal combustion engines throughout much of the world. The emissions standards are not merely regulating the pollutants emitted by an internal combustion engine that is operating at steady state. Emissions tests often include thousands of data points collected over a certain length of time and under various engine operating conditions. For example, the results of an emissions test often include emissions data from cold start-up and high engine demand situations. Consequently, engines must be designed to operate efficiently and within emissions regulations over a variety of operating conditions.

Some engines may be particularly efficient when operating under steady state conditions and after the aftertreatment components have had sufficient time to reach optimal operating temperatures. However, such systems may suffer from poor start-up performance or may emit an excessive amount of pollutants when accelerating. Specifically, compression-ignited engines (e.g., diesel engines) often emit large amounts of nitrogen oxides while accelerating or during transition periods (e.g., start-up). These peaks of nitrogen oxide emissions can result in an engine either failing to pass regulated emissions standard or may require additional aftertreatment components or sacrifice performance in order to meet the emissions standards.

SUMMARY

Various embodiments provide for an apparatus, system and method for reducing the emission of nitrogen oxides in an internal combustion engine system. Exhaust gas directly or indirectly downstream of the internal combustion engine is at least selectively stored in an exhaust gas storage region. Upon the occurrence of at least one exhaust gas insertion enablement condition, indicative of a potential period where the emission of nitrogen oxides (NOx) will increase or a period where the emission of NOx is actually increasing, the stored exhaust gas is inserted into the internal combustion engine to assist in reducing the emission of the nitrogen oxides. Exhaust gas insertion enablement conditions may include, but are not limited to, the actuation of a throttle (accelerator) pedal, a predetermined level of nitrogen oxides being sensed in the exhaust manifold of the internal combustion engine, a predetermined level of nitrogen oxides being sensed in the aftertreatment system, an indication that the internal combustion engine is about to experience an increase in engine load, an indication relating to a speed of the vehicle, and a predetermined feedback signal from an associated transmission. The exhaust gas storage volume may be filled during strategic periods when the emissions of nitrogen oxides are low and/or there is a low need for the recirculation of exhaust gas.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The subject matter of the present application has been developed in response to the present state of the art, and in particular, in response to the problems and needs in the art that have not yet been fully solved by currently available engine systems. One problem associated with prior art engine systems is the difficulty of preventing the emission of nitrogen oxides (NOx) during transitional periods of engine operation.

Accordingly, the subject matter of the present application has been developed to provide an engine system that utilizes stored exhaust gas to reduce NOx emissions, thus overcoming at least some shortcomings of the prior art systems.

Figure 1:
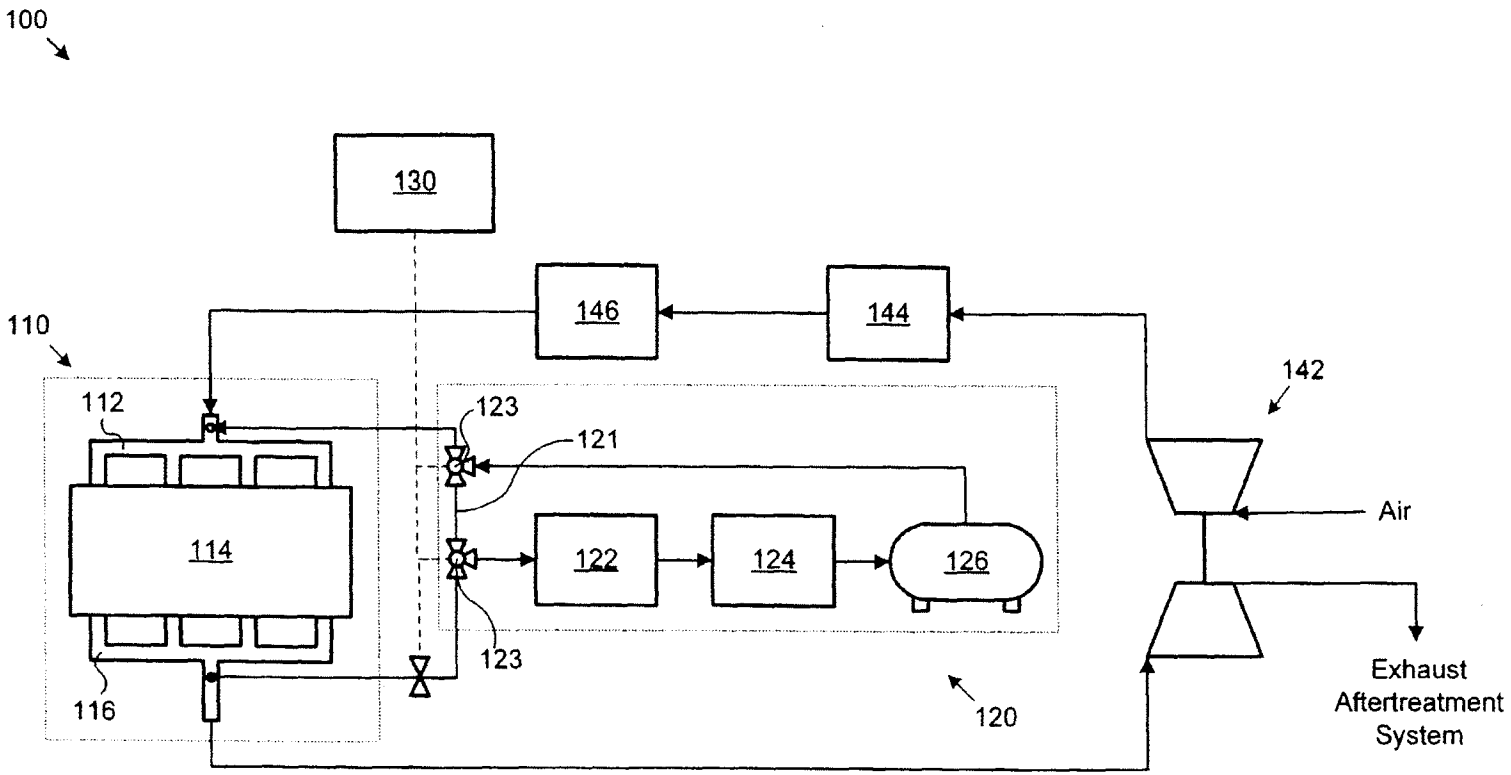
FIG. 1 is a schematic block diagram of a system for reducing the emission of nitrogen oxides from an internal combustion engine, according to one embodiment.

FIG. 1 is a schematic block diagram of a system 100 for reducing the emission of NOx from an internal combustion engine 110, according to one embodiment. The system 100 includes the internal combustion engine 110, an exhaust gas recirculation subsystem 120, and a controller apparatus 130, among other components. The internal combustion engine 110 includes an intake manifold 112, combustion chambers 114, and an exhaust manifold 116. The exhaust gas recirculation subsystem 120, according to one embodiment, includes a separation component 122, a compressor 124, and an exhaust gas storage tank 126. In one embodiment, the controller apparatus 130 includes a NOx emissions module 132, an exhaust gas storing module 134, an exhaust gas injection module 136, and an exhaust gas separation module 138. Further details relating to the controller apparatus 130 and a method 300 for reducing NOx emissions are included below with reference to FIGS. 2 and 3.

According to one embodiment, the internal combustion engine 110 includes an intake manifold 112, combustion chambers 114, and an exhaust manifold 116. The intake manifold 112 and the exhaust manifold 116 are for feeding and receiving fluid flow to and from the cylinders 114 of the internal combustion engine 110, respectively. The engine 110 can be a spark-ignited internal combustion engine, such as a gasoline fueled engine, or a compression-ignited internal combustion engine, such as a diesel fueled engine; however, NOx peak emissions are generally an issue relating to compression-ignited engines.

The system 100 may include air intake lines that direct air from the atmosphere into the internal combustion engine 110. The air intake lines may include a series of pipes or tubes through which the directed air flows. According to one embodiment, the air intake lines may be in fluid communication with a turbocharger compressor 142. Generally the air entering the intake lines is at atmospheric pressure; thus, a turbocharger compressor 142 can be used to increase the pressure and density of the air before being introduced into the combustion chambers 114. The turbocharger compressor 142 is rotatably driven by the turbocharger turbine 143, which is driven by the exhaust gas stream exiting the engine 110. According to one embodiment, the air intake lines may also include an intake throttle 144 and an air cooler 146. The intake throttle 144 can control the flow-rate of air into the system 100 and the air cooler 146 cools the air prior to being introduced into the engine 110. Throughout this disclosure, the term "air" will refer to the fluid flowing in the air intake lines and into the combustion chambers 114 via the intake manifold 112. The term "exhaust gas" or "exhaust gas stream" will refer generally to the fluid flowing in the exhaust gas lines after exiting the combustion chambers 114 via the exhaust manifold 116. In other words, the composition, pressure, and temperature of the "air" and the "exhaust gas" may vary throughout the system 100 as the fluid flows through different components.

Fuel is added to the air before being combusted in the engine 110. Fuel can be added upstream of the turbocharger compressor 142, downstream from the compressor 142 but before entering the engine 110 (i.e. in the air intake manifold 112), or directly into the combustion chambers 114 of the engine 110 via one or more fuel injectors (not depicted). Generally, the fuel is supplied from a fuel tank and pumped through a fuel delivery system prior to being injected into the system. Whether the fuel is injected directly into the combustion chambers or injected into the air upstream of the engine, the combined fuel and air (and potentially some re-circulated exhaust gas, see below) is ignited and combusted via a spark-ignited or compression-ignited system. Combustion of the fuel produces exhaust gas that is operatively vented through the exhaust manifold 116.

The system 100 may also include an exhaust gas recirculation subsystem that includes, according to one embodiment, a compressor 124 and an exhaust gas storage tank 126. Conventional exhaust gas recirculation lines are configured to re-circulate at least a portion of exhaust gas in the exhaust manifold 116 or the exhaust lines back to the intake manifold 112 or the intake lines. Conventional exhaust gas recirculation lines can connect to the air intake lines and, in some instances, the recirculation lines can be directly connected to inject exhaust gas into the combustion chambers 114. In particular embodiments, however, it is alternatively possible for the exhaust gas recirculation line to accept exhaust gas further downstream from the engine, for example, immediately downstream the diesel particulate filter (DPF) or immediately downstream from the selective catalytic reduction (SCR) catalyst. It may also be possible to use a recirculation line (downstream from the DPF or SCR) that is entirely separate from a conventional exhaust gas recirculation line. In other words, a system could have both a conventional exhaust gas recirculation subsystem and a separate subsystem used primarily or exclusively for the temporary storing of exhaust gases and their selective insertion into the internal combustion engine 110.

The exhaust gas recirculation subsystem 120 of the present disclosure also includes a bypass line 121 and various valves 123. The valves can be configured to re-circulate air in substantially the same manner as conventional exhaust gas recirculation lines. In other words, when the valves 123 are actuated to direct exhaust gas flow through the bypass line 121, the exhaust gas recirculation subsystem 120 of the present disclosure functions in substantially the same manner as conventional recirculation systems. However, the valves 123 may also direct exhaust gas flow towards the compressor 124 and the exhaust gas storage tank 126. As exhaust gas passes through the compressor 124, the pressure and density of the gas increases and the exhaust gas may be subsequently stored in the exhaust gas storage tank 126. The compressor 124 may be driven by the engine 110 or may be electrically actuated via the battery, for example. The gas stored in the tank 126 can be subsequently injected into the combustion chambers 114 to avoid excessive NOx emissions.

Additional details relating to storing the exhaust gas in the exhaust gas storage tank 126 and injecting the exhaust gas back into the internal combustion engine 110 are included below with reference to FIGS. 2 and 3. It should be noted that, while the term "injecting" is used to describe the introduction of exhaust gas back into the internal combustion engine 110, it is not necessary for a mechanical, pneumatic or similar action to "force" the exhaust gas into the internal combustion engine 110. Rather, it would be understood by one of ordinary skill in the art that, for example, the simple opening or a valve or similar structure could result in a release of compressed gas from the exhaust gas storage tank 126 and subsequent insertion of exhaust gas into the internal combustion engine 110.

In another embodiment, a separate exhaust gas storage tank 126 is not even necessary. Instead, the bypass line 121 may include valves or similar structures that can temporarily store exhaust gas within the bypass line when exhaust gas recirculation is not necessary. For example, when a vehicle is in an idling or cruising state, there is less need for exhaust gas recirculation since there few nitrogen oxides will be produced by the engine during such times. Therefore, the bypass line may be selectively closed, thereby storing exhaust gas therein for later use.

The exhaust gas recirculation subsystem 120 may also include a separation component 122, as depicted. The separation component 122 may be implemented in certain embodiments of the system 100 in order to separate out certain constituents of the exhaust gas stream. For example, in one implementation the separation component 122 comprises a separation membrane for separating carbon dioxide from the other exhaust gas constituents (e.g., water, nitrogen oxides, particulates, etc.). The separated carbon dioxide may be stored in the exhaust gas storage tank 126 and the remaining constituents can be stored in a separate tank (not depicted) or can be recirculated to the intake manifold 112 (not depicted) or can be fed into the exhaust gas aftertreatment system.

Generally, the aftertreatment system is configured to receive the exhaust gas stream generated by the internal combustion engine 110 and treat the exhaust gas stream in order to remove various harmful chemical compounds and particulate emissions before venting the exhaust stream to the atmosphere. The aftertreatment system may include one or more emissions components for treating (i.e., removing pollutants from) the exhaust gas stream in order to meet regulated emissions requirements. Generally, emission requirements vary according to engine type. As briefly discussed above, emission tests for conventional internal combustion engines typically monitor the release of carbon monoxide, unburned hydrocarbons, diesel particulate matter such as ash and soot, and nitrogen oxides.

Figure 2:
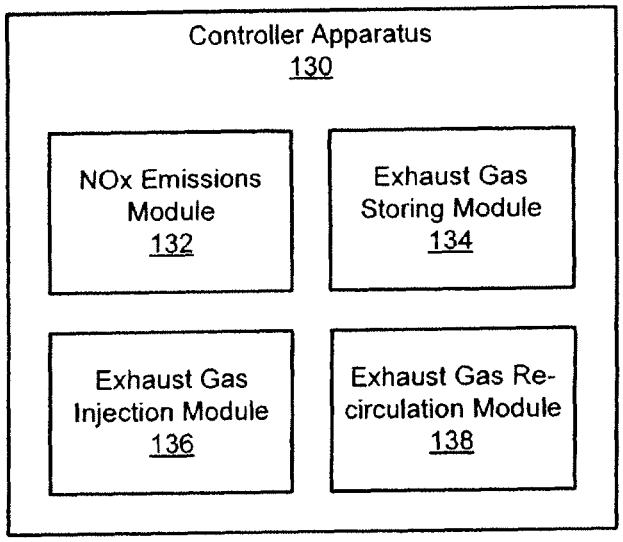
FIG. 2 is a schematic block diagram of a controller apparatus for reducing the emission of nitrogen oxides from an internal combustion engine, according to one embodiment.

FIG. 2 is a schematic block diagram of a controller apparatus 130 for reducing NOx emissions from an internal combustion engine 110, according to one embodiment. The controller apparatus 130 includes an NOx emissions module 132, an exhaust gas storing module 134, an exhaust gas injection module 136, and an exhaust gas separation module 148. The controller apparatus 130, as depicted in FIG. 1, controls the valves (depicted by the dashed communication lines) and various other components (communication lines not depicted) in the system 100. The NOx emissions module 132 is configured to sense the level of NOx emissions from the internal combustion engine 110. The NOx emissions module 132 may receive information from detectors and measuring devices throughout the system. For example, temperature and pressure gauges may be positioned at various locations along the intake manifold 112, the combustion chambers 114, and/or the exhaust manifold 116. The information received from such gauges may be interpreted by the NOx emissions module 132 in order to determine or predict when excessive levels of NOx will be emitted from the engine. Thus, in one embodiment, the NOx emissions module 132 includes virtual sensors that, based on input from actual sensors that are measuring the conditions in the system, calculate the likelihood of and predict the occurrence of NOx emissions peaks. In another embodiment, sensors positioned in the exhaust manifold 116 or in the engine aftertreatment system may provide feedback when high levels of NOx are being emitted.

In various embodiments, rather than directly sensing the level of NOx emissions from the internal combustion engine 110, the controller apparatus 130 determines whether one or more exhaust gas insertion enablement conditions have been met. An exhaust gas insertion enablement condition may represent, for example, a situation where it is likely that the vehicle may be entering, or may be about to enter, an engine transition period or a period where the vehicle may be about to accelerate. An enablement condition may also represent a situation where the engine load may be about to increase significantly, for example when the vehicle is about to begin an uphill climb. Examples of enablement conditions may include, but are not limited to the actuation of a throttle (accelerator) pedal, a predetermined level of nitrogen oxides being sensed in the exhaust manifold 166, a predetermined level of nitrogen oxides being sensed in the aftertreatment system, an indication relating to a speed of the vehicle, and a predetermined feedback signal from an associated transmission, and an indication that the internal combustion engine 110 is about to experience an increase in engine load. A global positioning system (GPS) associated with the vehicle may be used to determine whether the internal combustion engine 110 is about to experience in engine load. For example, an increase in engine load can be predicted if an associated GPS system indicates that the vehicle is approaching a location where an uphill climb is imminent. In those situations where engine load increase can be predicted ahead of time, it is possible to drastically reduce or even eliminate any increase in NOx emissions by providing compressed exhaust gas ahead of time. In those instances where an enablement condition is not detected until an increase in engine load is already occurring, the resulting NOx spike can still be reduced.

The exhaust gas storing module 134 controls the compression and storage of exhaust gas. In one embodiment, the exhaust gas storing module 134 may maintain the exhaust gas storage tank 126 at a certain pressure by periodically opening the valves 123 to charge the tank 126. In another embodiment, exhaust gas storing module 134 may charge the exhaust gas tank 126 during engine transition periods or when the engine is accelerating. During such periods, the exhaust gas may be super saturated with pollutants or the aftertreatment system may be unable to sufficiently treat the emitted pollutants to meet regulated emissions standards. For example, upon start-up, the engine components and the aftertreatment components are cold and may not adequately convert and/or treat the exhaust gas. Thus, the exhaust gas storing module 134 may determine to charge the exhaust gas storage tank 126 during these time periods in order to capture the exhaust gas with the worst emission ratings, including periods of high NOx emissions.

In another embodiment, the exhaust gas storing module 134 may systematically and periodically charge the exhaust gas storage tank 126 in order to maintain the a certain temperature or pressure within the tank. Additionally, at certain times the exhaust gas storage tank 126 may be frequently drawn from (see the description of the exhaust gas injection module below) in order to reduce NOx emissions. In such situations, the exhaust gas storing module 134 may charge the tank more frequently in order to maintain a certain pressure threshold within the tank 126.

The exhaust gas storing module 134 may also be configured to selectively charge the exhaust gas storage tank 126 during periods when exhaust gas recirculation is likely unnecessary and/or when it is unlikely for exhaust gas to be inserted into the internal combustion engine 110. For example, during prolonged periods of idling or cruising, exhaust gas recirculation becomes less necessary due to a lower likelihood of nitrogen oxides being emitted, and, for the same reason, there is likely little or no need to insert compressed exhaust gas from the exhaust gas storage tank 126. Such events may be referred to as exhaust gas filling enablement conditions in various embodiments.

The exhaust gas injection module 136 is configured to control the injection of exhaust gas from the tank 126 into the internal combustion engine 110. As briefly described above, at various times the NOx emissions module 132 may measure or predict when high levels of NOx are being emitted and the NOx emissions module 132 may send a signal to the exhaust gas injection module 136 requesting/commanding for an injection of exhaust gas. The exhaust gas injection module 136, according to one embodiment, controls various valves and delivery sub-systems for injecting the exhaust gas into the combustion chamber 114. The exhaust gas injection module 136 may also communicate with the exhaust gas storing module 134 when the pressure in the exhaust gas storage tank 126 is low. The timing and frequency of the injection events may be based on requests or signals from the NOx emissions module 132 or the timing and frequency of the injection events may be based on system models that predict, based on the specifics of a given application, that periodic injections improve the operation and/or emissions of the internal combustion engine 110.

The controller apparatus 130 may also include an exhaust gas separation module 138. As described above, in some embodiments it may be preferable or advantageous to remove or isolate certain constituents from the exhaust gas stream before storing the exhaust gas in the tank 126. The exhaust gas separation module 138 is configured to control the operation of the separation component 122, according to one embodiment. For example, under certain circumstances it may be beneficial for the exhaust gas tank 26 to only include carbon dioxide as opposed to the other constituents of the exhaust gas stream. The exhaust gas separation module 138 may control a separation membrane that isolates carbon dioxide from exhaust gas.

Figure 3:
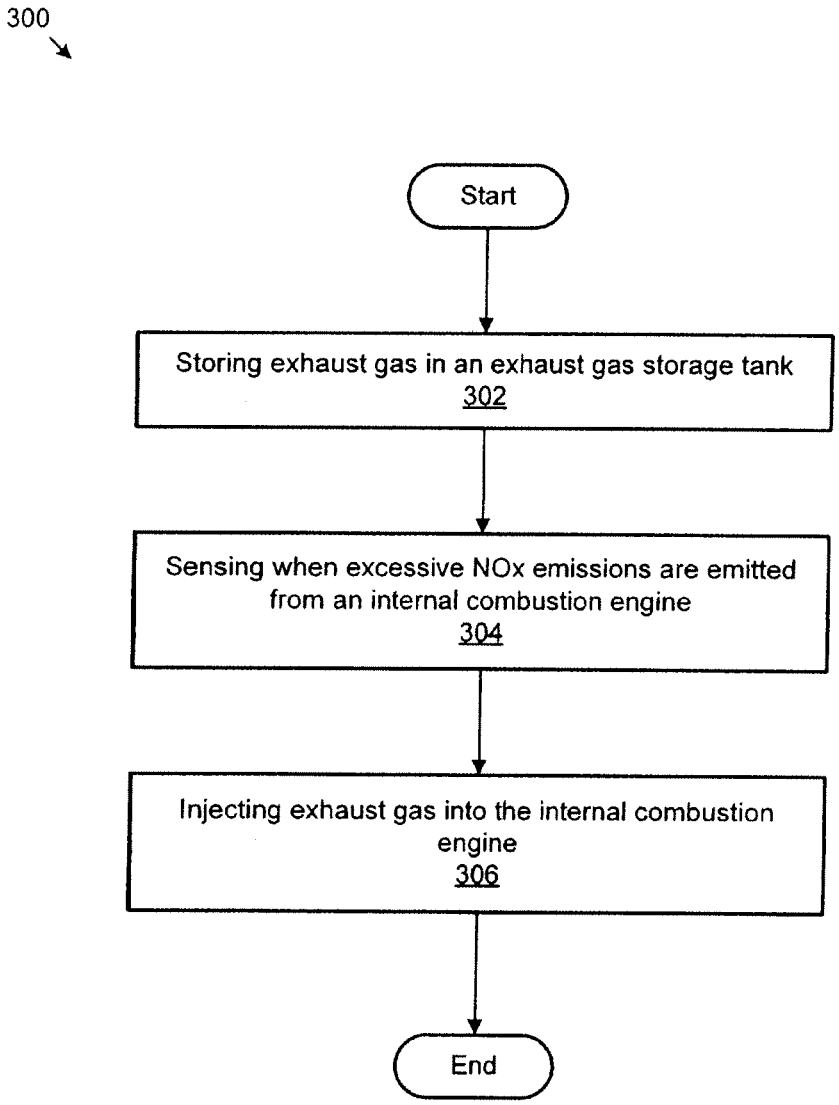
FIG. 3 is a schematic flowchart diagram of a method for reducing the emission of nitrogen oxides from an internal combustion engine, according to one embodiment.

FIG. 3 is a schematic flowchart diagram of a method 300 for reducing NOx emissions from an internal combustion engine, according to one embodiment. The method 300 includes storing 302 exhaust gas in an exhaust gas storage tank 126, sensing 304 when NOx emissions are high, and injecting 306 exhaust gas stored in the exhaust gas storage tank 126 into the internal combustion engine 110 to reduce NOx emissions. According to another embodiment, the method 300 may further include separating 308 certain constituents of the exhaust gas before charging the exhaust gas storage tank 126.

As described above, storing 302 a portion of the exhaust gas may occur all at once, such as upon engine start-up, or the tank 126 may be periodically and/or systematically charged during operation of the internal combustion engine 110. The valves 123 involved with controlling the flow of exhaust gas to the tank 126 may be opened for a certain period of time in order to allow a specific amount of exhaust gas to flow into the compressor 124. During this step in the method, the compressor 124 may also be operating to increase the pressure of the exhaust gas, thus increasing the amount of exhaust that can be stored in the tank 126.

The method 300 also includes sensing 304 when NOx emissions are high. As described above, the system 100 may include actual sensors that measure system conditions. The data collected by the actual sensors may then be analyzed using algorithms and system models for predicting when NOx emissions peaks will occur. The method 300 further includes injecting 306 the exhaust gas into the combustion chambers 114. This step in the method may be triggered by a predicted NOx emissions peak or because periodic exhaust gas injection may increase the fuel efficiency and improve the emissions of the internal combustion engine 110.

Figure 4:
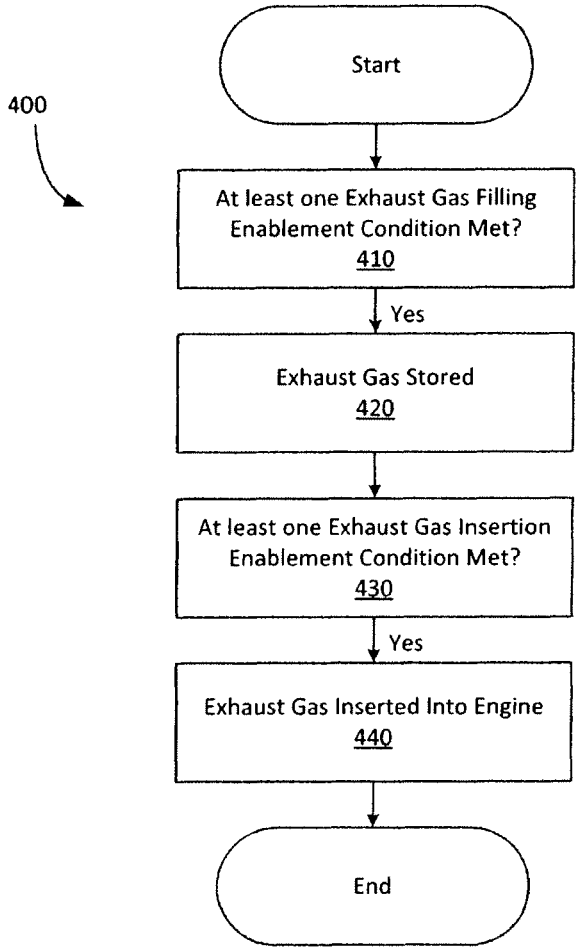
FIG. 4 is a schematic flowchart diagram of a method for reducing the emission of nitrogen oxides from an internal combustion engine, according to another embodiment.

FIG. 4 is a schematic flowchart diagram of a method 400 for reducing NOx emissions from an internal combustion engine, according to a different embodiment. The method 400 includes, at 410, determining whether at least one exhaust gas filling enablement condition is met. As discussed previously, exhaust gas filling enablement conditions may comprise, for example, the vehicle being an idling or cruising state for a prolonged period of time. If the at least one exhaust gas filling enablement condition is met, then at 420 exhaust gas discharged from the internal combustion engine is stored in exhaust gas storage tank or other exhaust gas storage volume.

At 430, it is determined whether at least one exhaust gas insertion enablement condition is being met. As discussed previously, such exhaust gas insertion enablement conditions may comprise, for example, the actuation of a throttle (accelerator) pedal, a predetermined level of nitrogen oxides being sensed in the exhaust manifold of the internal combustion engine, a predetermined level of nitrogen oxides being sensed in the aftertreatment system, an indication that the internal combustion engine is about to experience an increase in engine load, an indication relating to a speed of the vehicle, and a predetermined feedback signal from an associated transmission.

If it is determined that the at least one exhaust gas insertion enablement condition is being met, then exhaust gas that has been stored in the exhaust gas storage volume is inserted into the internal combustion engine at 440 to reduce the emission of nitrogen oxides.

As will be appreciated by one skilled in the art, aspects of the present disclosure may be embodied as a module, a method, or a computer program product embodied in a tangible, non-transitory computer readable medium. Accordingly, aspects of the presently disclosed method and modules may take the form of an entirely hardware embodiment, an entirely software embodiment (including firmware, resident software, micro-code, etc.) or an embodiment combining software and hardware aspects that may all generally be referred to herein as a "method." Furthermore, aspects of the present modules may take the form of a computer program product embodied in one or more computer readable medium(s) having computer readable program code embodied thereon.

Many of the functional units described in this specification have been labeled as steps in a method or modules, in order to more particularly emphasize their implementation independence. For example, a module may be implemented using a hardware circuit comprising custom VLSI circuits or gate arrays, off-the-shelf semiconductors such as logic chips, transistors, or other discrete components. A step in the module may also be implemented using programmable hardware devices such as field programmable gate arrays, programmable array logic, programmable logic devices or the like.

Modules may also be implemented using software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where modules are implemented in software, the software portions are stored on one or more computer readable mediums.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing.

More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

In the context of this document, a computer readable storage medium may be any tangible medium that can contain, or store a program for use by or in connection with an instruction execution system, apparatus, or device.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Additionally, instances in this specification where one element is "coupled" to another element can include direct and indirect coupling. Direct coupling can be defined as one element coupled to and in some contact with another element.

Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Furthermore, the described features, structures, or characteristics of the subject matter described herein may be combined in any suitable manner in one or more embodiments. In the following description, numerous specific details are provided, to provide a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for reducing emissions of nitrogen oxides, the system comprising:

an internal combustion engine, comprising:

an intake manifold structured to provide intake air to the internal combustion engine, an exhaust manifold structured to receive exhaust gas from the internal combustion engine, and an exhaust line fluidly coupled to the exhaust manifold;

a first exhaust gas recirculation subsystem comprising a first exhaust gas recirculation line structured to transmit exhaust gas from one of the exhaust manifold and the exhaust line to the intake manifold;

a second exhaust gas recirculation subsystem, comprising:

an exhaust gas compressor, an exhaust gas storage volume downstream of the exhaust gas compressor, and a second exhaust gas recirculation line structured to transmit exhaust gas from the exhaust line to the exhaust gas compressor, from the exhaust gas compressor to the exhaust gas storage volume, and from the exhaust gas storage volume to the intake manifold; and a controller apparatus in electrical communication with the second exhaust gas recirculation subsystem, the controller apparatus configured to control insertion of compressed exhaust gas from the exhaust gas storage volume to the internal combustion engine, thereby reducing the emission of nitrogen oxides.

2. The system of claim 1, wherein the controller selectively controls the insertion of the exhaust gas into the internal combustion engine in response to at least one exhaust gas insertion enablement condition being met.

3. The system of claim 2, wherein the at least one exhaust gas insertion enablement condition comprises actuation of a throttle pedal.

4. The system of claim 2, wherein the at least one exhaust gas insertion enablement condition comprises a predetermined level of nitrogen oxides being sensed in an exhaust manifold of the internal combustion engine.

5. The system of claim 2, wherein the at least one exhaust gas insertion enablement condition comprises a predetermined level of nitrogen oxides being sensed in an aftertreatment system associated with the internal combustion engine.

6. The system of claim 2, wherein the at least one exhaust gas insertion enablement condition comprises an indication that the internal combustion engine is about to experience an increase in engine load.

7. The system of claim 6, wherein the indication is based upon information provided by an associated global positioning system.

8. The system of claim 2, wherein the at least one exhaust gas insertion enablement condition comprises an indication relating to a speed of a vehicle within which the system is located.

9. The system of claim 2, wherein the at least one exhaust gas insertion enablement condition comprises a predetermined feedback signal from an associated transmission.

10. The system of claim 1, wherein the first exhaust gas recirculation system is configured to withdraw untreated exhaust gas from downstream of the internal combustion engine.

11. The system of claim 1, wherein the second exhaust gas recirculation subsystem withdraws exhaust gas from a location downstream of a diesel particulate filter in an exhaust gas aftertreatment system associated with the internal combustion engine.

12. The system of claim 1, wherein the second exhaust gas recirculation subsystem withdraws exhaust gas from a location downstream of a selective catalytic reduction catalyst in an exhaust gas aftertreatment system associated with the internal combustion engine.

13. The system of claim 1, wherein the exhaust gas storage volume comprises an exhaust gas storage tank separate from the second exhaust gas recirculation line in the second exhaust gas recirculation subsystem.

14. The system of claim 1, wherein the exhaust gas storage volume comprises a portion of the second exhaust gas recirculation line that is sealable at an inlet and an outlet thereof when exhaust gas recirculation via the second exhaust gas recirculation subsystem is not necessary.

15. The system of claim 1, wherein the controller apparatus is further configured to control filling of the exhaust gas storage volume based upon occurrence of at least one exhaust gas filling enablement condition.

16. The system of claim 1, wherein the at least one exhaust gas filling enablement condition comprises an identification that a vehicle within which the internal combustion engine is located is in an idling state.

17. The system of claim 1, wherein the at least one exhaust gas filling enablement condition comprises an identification that a vehicle within which the internal combustion engine is located is in a coasting state.

18. The system of claim 1, wherein the exhaust gas compressor is configured to compress the exhaust gas for storage in the exhaust gas storage volume.

19. A method for reducing emissions of nitrogen oxides, the method comprising:

providing first and second exhaust gas recirculation subsystems;

storing, in an exhaust gas storage volume of the second exhaust gas recirculation subsystem, exhaust gas discharged from an internal combustion engine, the exhaust gas being compressed by an exhaust gas compressor, the exhaust gas storage volume being downstream of the exhaust gas compressor;

determining that at least one exhaust gas insertion enablement condition is being met; and if it is determined that the at least one exhaust gas insertion enablement condition is being met, inserting compressed exhaust gas stored in the exhaust gas storage volume into the internal combustion engine to reduce the emission of nitrogen oxides.

20. The method of claim 19, wherein the at least one exhaust gas insertion enablement condition comprises actuation of a throttle pedal on a vehicle within which the internal combustion engine is located.

21. The method of claim 19, wherein the at least one exhaust gas insertion enablement condition comprises a predetermined level of nitrogen oxides being sensed in an exhaust manifold of the internal combustion engine.

22. The method of claim 19, wherein the at least one exhaust gas insertion enablement condition comprises a predetermined level of nitrogen oxides being sensed in an aftertreatment system associated with the internal combustion engine.

23. The method of claim 19, wherein the at least one exhaust gas insertion enablement condition comprises an indication that the internal combustion engine is about to experience an increase in engine load.

24. The method of claim 23, wherein the indication is based upon information provided by an associated global positioning system.

25. The method of claim 19, wherein the at least one exhaust gas insertion enablement condition comprises an indication relating to a speed of a vehicle within which the system is located.

26. The method of claim 19, wherein the at least one exhaust gas insertion enablement condition comprises a predetermined feedback signal from an associated transmission.

27. The method of claim 19, wherein the stored exhaust gas is taken from a location downstream of the internal combustion engine.

28. The method of claim 19, wherein the stored exhaust gas is taken from a location downstream of a diesel particulate filter in an exhaust gas aftertreatment system associated with the internal combustion engine.

29. The method of claim 19, wherein the stored exhaust gas is taken from a location downstream of a selective catalytic reduction catalyst in an exhaust gas aftertreatment system associated with the internal combustion engine.

30. The method of claim 19, wherein the exhaust gas storage volume comprises an exhaust gas storage tank separate from an exhaust gas recirculation line in the second exhaust gas recirculation subsystem associated with the internal combustion engine.

31. The method of claim 19, wherein the exhaust gas storage volume comprises a portion of an exhaust gas recirculation line that is sealable at an inlet and an outlet thereof when exhaust gas recirculation via the second exhaust gas recirculation subsystem is not necessary.

32. The method of claim 19, wherein the exhaust gas is selectively stored in the exhaust gas storage volume based upon occurrence of at least one exhaust gas filling enablement condition.

33. The method of claim 19, wherein the at least one exhaust gas filling enablement condition comprises an identification that a vehicle within which the internal combustion engine is located is in an idling state.

34. The method of claim 19, wherein the at least one exhaust gas filling enablement condition comprises an identification that a vehicle within which the internal combustion engine is located is in a coasting state.

35. A computer program product, embodied in a tangible, non-transitory computer-readable medium, comprising computer executable instructions configured to cause a system to:

provide first and second exhaust gas recirculation subsystems;

store, in an exhaust gas storage volume of the second exhaust gas recirculation subsystem, exhaust gas discharged from an internal combustion engine, the exhaust gas being compressed by an exhaust gas compressor, the exhaust gas storage volume being downstream of the exhaust gas compressor;

determine that at least one exhaust gas insertion enablement condition is being met; and if it is determined that the at least one exhaust gas insertion enablement condition is being met, insert compressed exhaust gas stored in the exhaust gas storage volume into the internal combustion engine to reduce emissions of nitrogen oxides.

36. The computer program product of claim 35, further comprising computer executable instructions configured to cause the system to determine whether at least one exhaust gas filling enablement condition, and wherein the storing of the discharged exhaust gas occurs when the at least one exhaust gas filling enablement condition is met.

* * * * *